US009895579B1

(12) United States Patent
Walterscheid

(10) Patent No.: US 9,895,579 B1
(45) Date of Patent: Feb. 20, 2018

(54) TETHERED HAND TOY

(71) Applicant: FSD, LLC, Bend, OR (US)

(72) Inventor: Steven Edward Walterscheid, Bend, OR (US)

(73) Assignee: FSD, LLC, Bend, OR (US)

( * ) Notice: Subject to any disclaimer, the term of this patent is extended or adjusted under 35 U.S.C. 154(b) by 0 days.

(21) Appl. No.: 15/227,930

(22) Filed: Aug. 3, 2016

(51) Int. Cl.
*A63B 43/00* (2006.01)
*A63B 43/06* (2006.01)
*A63B 67/08* (2006.01)
*A63B 69/00* (2006.01)

(52) U.S. Cl.
CPC ..... *A63B 43/06* (2013.01); *A63B 43/007* (2013.01); *A63B 67/08* (2013.01); *A63B 69/0079* (2013.01)

(58) Field of Classification Search
CPC ..... A63B 43/00; A63B 43/007; A63B 43/06; A63B 67/08; A63B 67/10; A63B 67/083; A63B 69/0079; A63B 69/0073
See application file for complete search history.

(56) References Cited

U.S. PATENT DOCUMENTS 442,675 A * 12/1890 Wilcox ..... A63B 67/086 473/514
2,408,160 A * 9/1946 Brunner ..... A63B 21/072 273/343
2,500,073 A * 3/1950 Hayes ..... A63B 43/007 473/575
2,852,261 A * 9/1958 Meminger ..... A63B 69/0079 473/147
3,049,352 A * 8/1962 Hancock ..... A63B 59/80 124/5
3,357,705 A * 12/1967 Blanchard ..... A63B 43/00 473/280
4,192,044 A * 3/1980 Ballerini ..... A44C 5/20 24/607
4,266,781 A * 5/1981 Blue ..... A63F 9/0278 473/575
5,236,383 A * 8/1993 Connelly ..... A63B 43/007 446/219
5,294,129 A * 3/1994 Brown ..... A63B 59/20 273/343
5,375,848 A 12/1994 Coleman
5,377,995 A * 1/1995 Clark ..... A63B 67/00 473/514
5,522,597 A 6/1996 Hanks
(Continued)

OTHER PUBLICATIONS

"Official Rules—Ladder Golf", <https://laddergolf.com/pages/official-rules>, pp. 1-7, retrieved on Nov. 13, 2017.*

*Primary Examiner* — Steven Wong
(74) *Attorney, Agent, or Firm* — LaMorte & Associates, P.C

(57) ABSTRACT

A skill toy that is juggled, spun, and flipped in one hand or between both hands. The skill toy has two subassemblies that each contains a rounded translucent shell. The translucent shell surrounds an internal illumination unit, wherein the rounded translucent shell has a maximum diameter of under two inches. The illumination units are motion activated and contain lights. A tether joins the subassemblies together. The tether can be selectively attached to, and detached from, the two subassemblies. The tether has a length of between four inches and six inches, so it is just long enough to span the back of a hand.

13 Claims, 8 Drawing Sheets

(56) References Cited

U.S. PATENT DOCUMENTS 5,580,336 A * 12/1996 Coallier ..... A63B 23/16 473/614
5,934,784 A * 8/1999 Dion ..... A43B 1/0036 362/103
6,308,956 B1 * 10/2001 Reid ..... A63B 43/007 273/343
6,889,982 B1 * 5/2005 Gove ..... A63B 63/00 273/343
7,223,150 B2 5/2007 Chernick et al.
7,328,902 B1 * 2/2008 White ..... A63B 63/00 273/343
7,374,496 B2 * 5/2008 Grant ..... A63B 69/0079 473/138
8,454,459 B1 * 6/2013 Reed ..... A63B 67/06 273/343
2004/0135318 A1 * 7/2004 Long ..... A63B 43/007 273/343
2005/0082761 A1 * 4/2005 Lynch ..... A63B 63/00 273/343
2006/0094573 A1 * 5/2006 Weck ..... A63B 21/0004 482/126
2007/0035093 A1 * 2/2007 Fuchs ..... A63B 67/06 273/343
2007/0246886 A1 * 10/2007 Hunt ..... A63B 67/002 273/343
2007/0257438 A1 * 11/2007 Deal ..... A63B 67/06 273/343
2008/0093803 A1 * 4/2008 Vallee ..... A63F 9/02 273/343
2009/0278316 A1 * 11/2009 LaMarte ..... A63B 63/00 273/343
2011/0037226 A1 * 2/2011 Nickles ..... A63B 43/06 273/343

* cited by examiner

TETHERED HAND TOY

BACKGROUND OF THE INVENTION

1. Field of the Invention

In general, the present invention relates to items, such as bolas, where two balls are joined together by a flexible tether. The present invention also relates to toy balls that contain internal lighting units for internally illuminating the toy balls.

2. Prior Art Description

Tethered balls, in the form of bolas, have existed as a hunting weapon throughout recorded history. Bolas consist of two balls, rocks or other weighted objects that are joined together by a flexible tether. Bolas typically have long tethers and are spun as they are thrown. When the bola strikes an animal's legs, wings or neck, the weighted objects cause the tether to wrap around the animal, therein incapacitating the animal.

Bolas are ancient weapons that are rarely used for hunting in the modern world. However, the physics of a bola are fascinating and have been adapted to other less deadly products. For example, in the toy industry, bolas have been made using rubber balls and string tethers. The toy bolas are used as projectiles in games where the target has poles or pegs around which the toy bola can wrap. Such prior art toy bolas are exemplified in U.S. Pat. No. 5,522,597 to Hanks, entitled Game Apparatus, and U.S. Pat. No. 5,375,848 to Colemant, entitled Bola Ball Game.

In such prior art, the balls used with the tether tend to be of a large size and a large mass. The tether provides significant wind resistance. As such, the balls must have a significant mass in order to be thrown any useful distance. A large diameter is also needed so that the ball can be effectively gripped and thrown. Accordingly, a diameter of at least 2.5 inches is required to enable the toy balls to be readily grasped and thrown. Few, if any, hand-thrown bolas exist with balls under a two inch diameter. This is because the balls become too small to be comfortably grasped and thrown. Also small diameter balls tend to lack the mass needed for a bola to travel long distances and effectively wrap around a target object.

In the toy industry, there are also many toys that are internally illuminated and contain activation mechanisms that are triggered by motion. Such illumination units have been placed in balls and in other objects that are thrown, bounced, or caught. Such prior art is exemplified by U.S. Pat. No. 7,223,150 to Chernick, entitled Illuminated Elastomeric Flying Disc And Its Method Of Manufacture.

In the present invention, the concept of a bola is transformed into a unique skill game toy. The skill game toy has two balls joined by a tether. However, the tether is shortened and the balls have a small diameter. The skill game toy is designed not to be thrown at an object, but rather, to be flipped and twirled in a user's hand. The combination of ball size and tether length combine to produce an advancement in the art, as is described and claimed below.

SUMMARY OF THE INVENTION

The present invention is a skill toy that is juggled, spun, and flipped in one hand or between both hands. The skill toy has two subassemblies that each contains a rounded translucent shell. The translucent shell surrounds an internal illumination unit, wherein the rounded translucent shell has a maximum diameter of under two inches. The illumination units are motion activated and contain lights that actually internally illuminate the translucent shell.

A tether joins the subassemblies together. The tether has a first end and an opposite second end. The tether can be selectively attached to, and detached from, the two subassemblies. The tether has a length of between four inches and six inches, so it is just long enough to span the back of a hand.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy assembly can be embodied in many ways, only one embodiment of the present invention is illustrated and described. The exemplary embodiment is selected in order to set forth one of the best modes contemplated for the invention. The illustrated embodiment, however, is merely exemplary and should not be considered a limitation when interpreting the scope of the appended claims.

Figure 1:
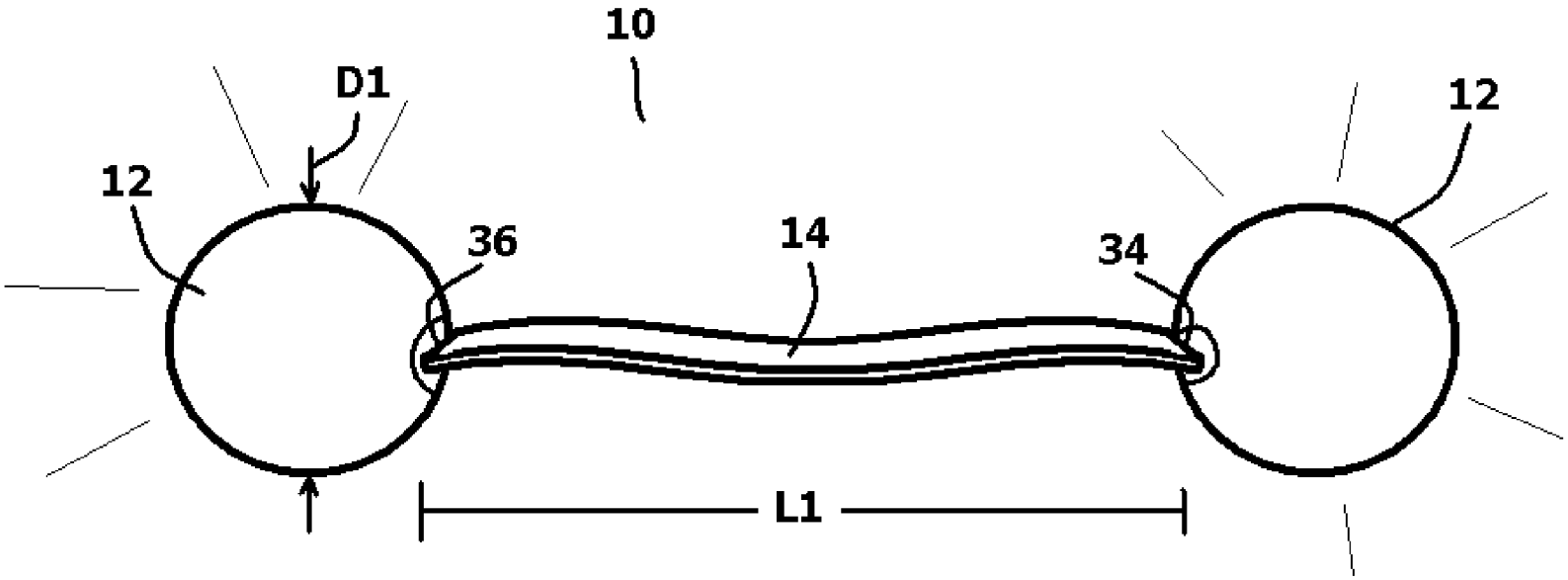
FIG. 1 is a perspective view of an exemplary embodiment of a toy assembly.
Figure 2:
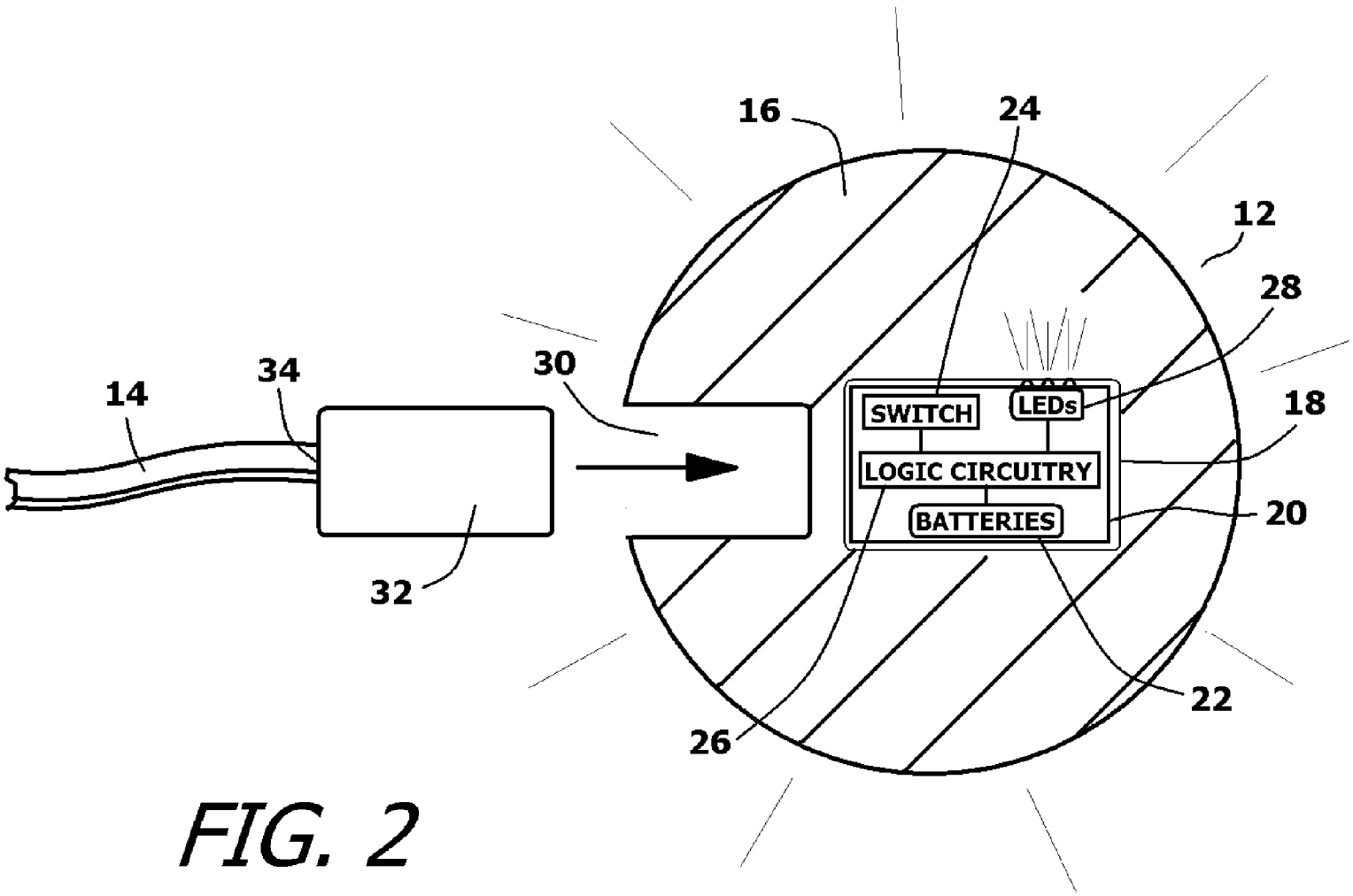
FIG. 2 is a combined cross-section and schematic showing the components within a ball-shaped subassembly of the toy assembly.

Referring to FIG. 1 and FIG. 2, a toy assembly 10 is shown. The toy assembly 10 has two ball-shaped subassemblies 12 that are joined together by a flexible tether 14. Each of the ball-shaped subassemblies 12 preferably has an external diameter D1 of between 0.5 inches and 2.0 inches. The flexible tether 14 has a preferred length of between four inches and six inches. The importance of these dimension ranges is later explained.

Each of the ball-shaped subassemblies 12 has a spherical shell 16. The spherical shell 16 is preferably made of a translucent elastomeric material. The elastomeric material has a high durometer, so as to provide the spherical shell 16 with a high resiliency and the ability to rebound well when impacted against a hard surface. Accordingly, it will be understood that the ball-shaped subassemblies 12 will bounce when dropped against a hard surface. Likewise, they will bounce against each other if the two ball-shaped subassemblies 12 collide while being manipulated.

An electronic unit 18 is disposed within each spherical shell 16. Each electronic unit 18 consists of a small circuit board 20 that supports a battery 22, a switch 24, a logic circuit 26 and at least one LED 28. The switch 24 is preferably an accelerometer switch or another such switch that can sense when the circuit board 20 is experiencing physical movement. The logic circuit 26 turns the LEDs 28 on for a predetermined period of time, such as a few seconds, each time movement is detected. Once the movement stops and the predetermined period of time for activation has expired, the logic circuit 26 turns the LEDs 28 off.

The LEDs 28 are bright enough to shine light through the translucent material of the spherical shell 16. As such, the spherical shell 16 appears to be internally illuminated when it experiences movement. The circuit board 20 can flash or sequence the lighting of the LEDs 28 when the LEDs 28 are activated, therein producing changing light patterns in the internal illumination of the ball-shaped subassemblies 12.

Each of the ball-shaped subassemblies 12 also includes a receptacle 30. The receptacle 30 is sized to receive and engage a connector 32, which is used to terminate the tether 14. The tether 14 can be a length of string, but is preferably a length of flat woven ribbon, like that of a sneaker shoelace. A flat ribbon adds a level of comfort to the toy assembly 10, as is later explained. A tether 14 of flat ribbon also provides a widened surface for a manufacturer's graphics.

The tether 14 has two free ends 34, 36. The ends 34, 36 of the tether 14 are terminated with connectors 32. The connectors 32 at either end 34, 36 of the tether 14 are identical. The connectors 32 are dimensioned and sized to engage the receptacles 30 formed into each of the ball-shaped subassemblies 12. The connectors 32 preferably engage the receptacles 30 with an interference fit, wherein friction keeps the connectors 32 engaged within the receptacles 30. Releasable mechanical features, such as threading or a tab lock can also be used. Regardless, it will be understood that each ball-shaped subassembly 12 will remain attached to the tether 14 and will not inadvertently separate. However, a user can detach each of the ball-shaped subassemblies 12 from the tether 14 when desired.

Figure 3:
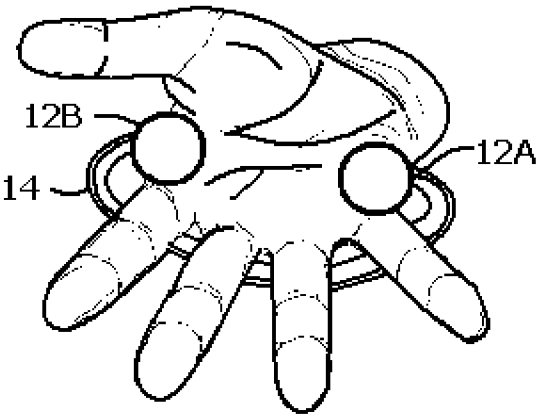
FIG. 3 shows the toy assembly in conjunction with a user's hand to illustrate the importance of length and size in proportion to the user's hand.

Referring to FIG. 3 in conjunction with FIG. 1 and FIG. 2, it will be understood that the toy assembly 10 is sized and dimensioned to be a skill game that is held in one hand and passed from hand to hand. The ball shaped subassemblies 12 are kept in a size range so that both of the ball-shaped subassemblies 12 can be held in the palm of the same hand by a user's thumb. This size range corresponds to a maximum diameter D1 on the ball-shaped assemblies 12 of between 0.5 inches and 2.0 inches. The length L1 of the tether 14 is held in a size range that is just long enough so it can span the back of the hand from one ball-shaped subassembly 12 to the other as both ball-shaped subassemblies 12 are being held in the palm of the same hand. This size range is between four inches and six inches.

With the size of the ball-shaped subassemblies 12 and the length of the tether 14 described, a person can perform a variety of tricks with the toy assembly 10. By way of example, one of the tricks is called a roundabout. To perform a roundabout, a user holds the toy assembly 10 in one hand with a first of the ball-shaped subassemblies 12A in the palm under the ring finger and a second of the ball-shaped subassemblies 12*b* pinched between the thumb and forefinger. See FIG. 4. The second of the ball-shaped subassemblies 12B is released as the hand is moved in a clockwise direction.

Figure 5:
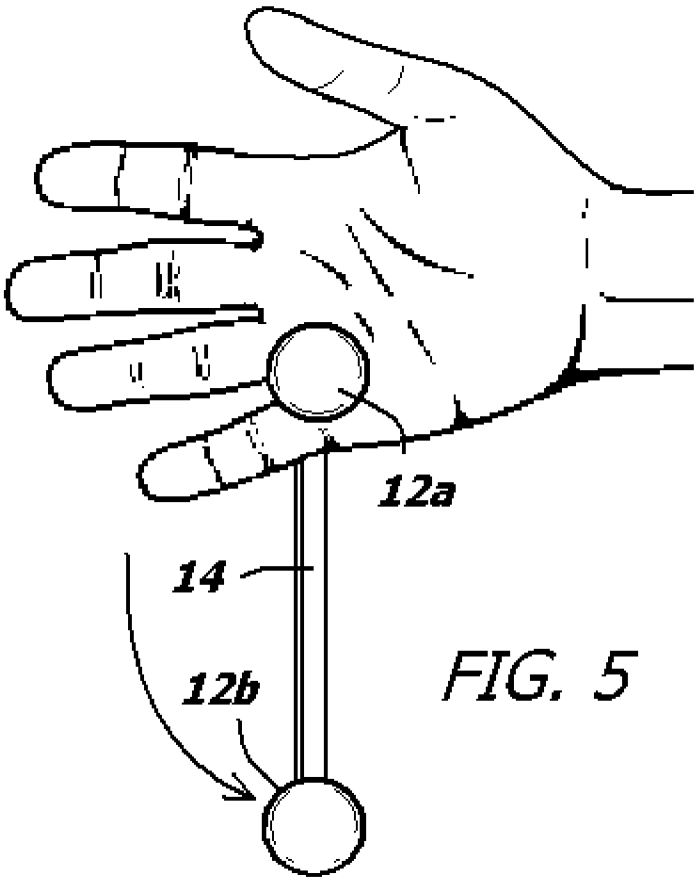
FIG. 5 shows the toy assembly in a second position of a performed skill manipulation.
Figure 6:
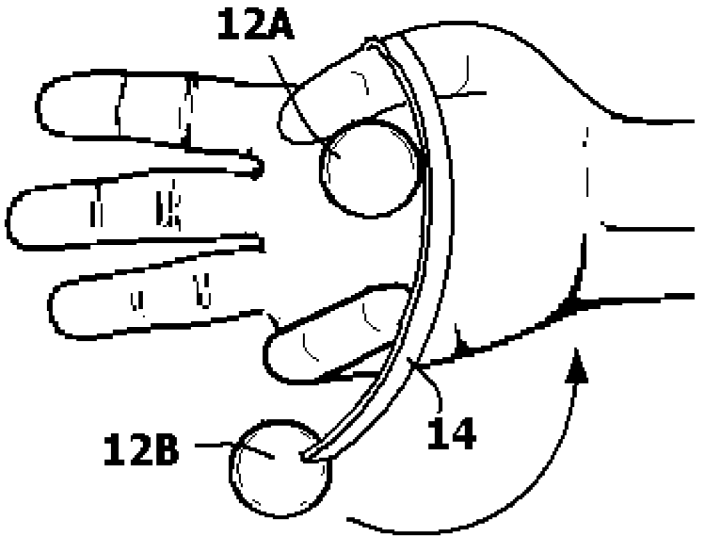
FIG. 6 shows the toy assembly in a third position of a performed skill manipulation.

This causes the second of the ball-shaped subassemblies 12*b* to rotate behind the hand. See FIG. 5 and eventually rotate under the pinky finger and up over the palm. The user then allows the tether 14 to rotate back over the thumb, where the second of the ball-shaped subassemblies 12 can again be caught between the thumb and forefinger. See FIG. 6.

Figure 7:
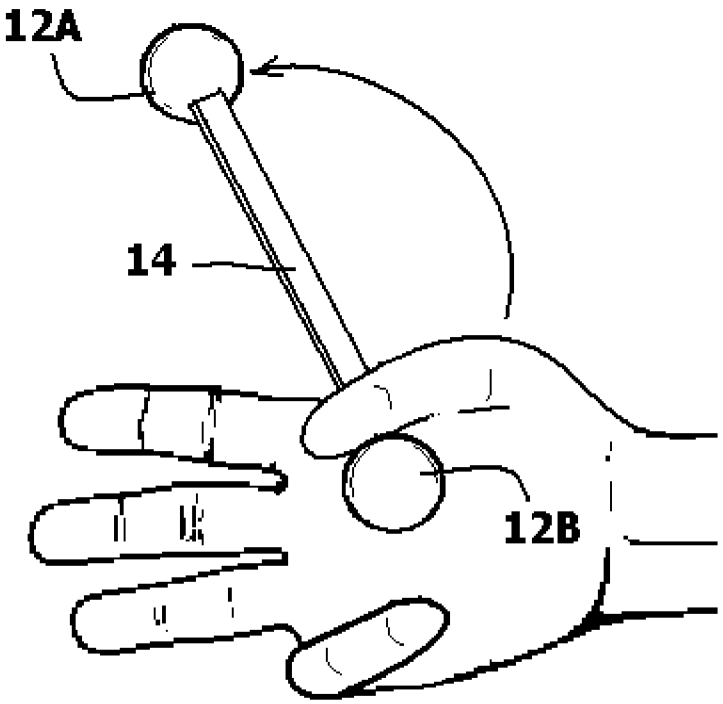
FIG. 7 shows the toy assembly in a fourth position of a performed skill manipulation.

This can end the trick. However, the tether 14 is taut and can transfer the energy of momentum to the first of the ball-shaped subassemblies 12A. The pinky finger can be bent forward to release the first of the ball shaped subassemblies 12A. The first of the ball-shaped subassemblies 12A then uses the momentum to rotate away from the palm and up over the forefinger to the back of the hand. See FIG. 7. The pinky finger can then be extended to catch the tether 14 between the pinky finger and the ring finger as it rotates around the back of the hand. See FIG. 8 The first of the ball-shaped subassemblies 12A is then caught under the ring finger and returns to the original position of FIG. 4.

Figure 4:
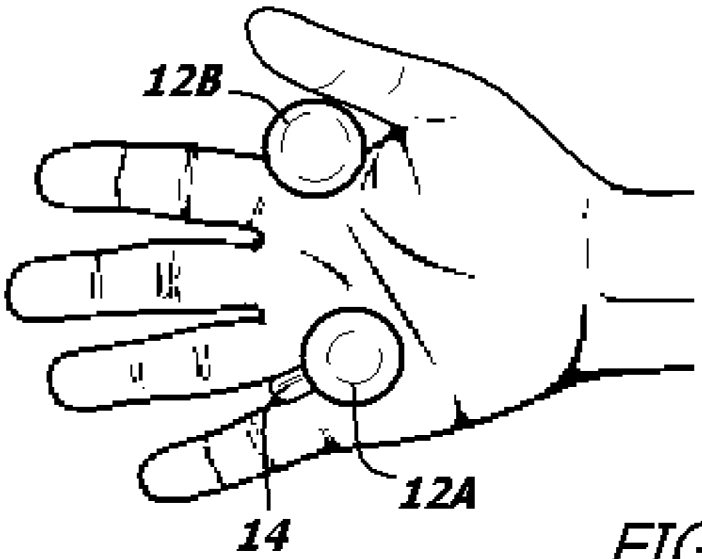
FIG. 4 shows the toy assembly in a first position of a performed skill manipulation.
Figure 8:
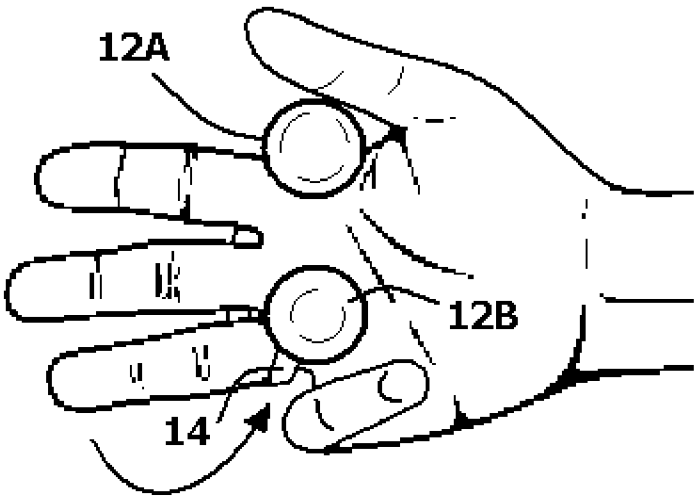
FIG. 8 shows the toy assembly in a fifth position of a performed skill manipulation.

It will be understood that the size of the ball-shaped subassemblies 12 and the length of the tether 14 between the ball-shaped subassemblies 12 is critical to the ability to perform a maneuver such as is described between FIG. 4 and FIG. 8. The ball-shaped assemblies 12 must be large and heavy enough to swing the tether 14 but small enough to be held in place by a finger over the palm. The tether 14 must be just long enough to enable the tether 14 to wrap around the back of one's hand. If the tether is too long or too short, it will over-wrap or under-wrap. Either way, it will not position one of the ball-shaped assemblies over the palm where it can be grasped between a finger and the palm.

Since many of the tricks involve swinging and wrapping the tether 14 around the hand, a tether 14 with a flat profile is preferred. A tether 14 with a flat profile prevents the tether 14 from rolling along a finger or the edge of the hand. A tether 14 with a flat profile also inhibits the tether 14 from cutting into the hand should the tether 14 come into contact with skin while taut.

It will be understood that the embodiment of the present invention that is illustrated and described is merely exemplary and that a person skilled in the art can make many variations to that embodiment. For instance, the ball-shaped subassemblies can be made with an oblong shape or a pear shape as a matter of design choice. All such embodiments are intended to be included within the scope of the present invention as defined by the claims.

What is claimed is:

1. A toy assembly comprising:

two subassemblies that each contain a rounded translucent shell, wherein each said rounded translucent shell has a maximum diameter of under two inches;

an illumination unit disposed within each said rounded translucent shell for internally illuminating each said rounded translucent shell;

a receptacle that extends into each said rounded translucent shell;

a tether that can selectively attach to, and detach from, said subassemblies, said tether having a first end and an opposite second end, wherein said tether has a length between said first end and said second end that is between four inches and six inches;

a first connector at said first end of said tether; and a second connector at said second end of said tether, wherein said first connector and said second connector are identical, and wherein said first connector and said second connector are sized to pass into either said receptacle on said subassemblies and engage said receptacle with an interference fit wherein friction keeps said first connector and said second connector engaged with each said receptacle until selectively pulled out of each said receptacle.

2. The toy assembly according to claim 1, wherein said internal illumination unit includes a battery, a logic circuit, and at least one LED.

3. The toy assembly according to claim 2, wherein said internal illumination unit contains a motion activator that activates said at least one LED when said internal illumination unit experiences motion.

4. The toy assembly according to claim 3, wherein said logic circuit causes said at least one LED to remain active for a predetermined period of time after said motion.

5. The toy assembly according to claim 1, wherein said translucent shell is made of an elastomeric material.

6. The toy assembly according to claim 1, wherein said tether is configured as a flat ribbon.

7. A toy assembly comprising:

a first translucent ball;

a first receptacle extending into said first translucent ball;

a second translucent ball;

a second receptacle extending into said translucent ball;

a ribbon tether having a first end and an opposite second end that can selectively attach to, and detach from, said first translucent ball and said second translucent ball, wherein said first end terminates with a first connector that is received within said first receptacle and secured with an interference fit where friction keeps said first connector engaged with said first receptacle until selectively pulled out of said first receptacle, and wherein said second end terminates with a second connector that is received within said second receptacle and secured with an interference fit, where friction keeps said second connector engaged with said second receptacle until selectively pulled out of said second receptacle, and wherein said ribbon tether has a length of between two inches and four inches between said first connector and said second connector.

8. The toy assembly according to claim 7, wherein said first translucent ball and said second translucent ball each have a diameter of between one-half inch and two inches.

9. The toy assembly according to claim 7 further including internal illumination units disposed within said first translucent ball and said second translucent ball for internally illuminating said first translucent ball and said second translucent ball.

10. The toy assembly according to claim 9, wherein each of said internal illumination units includes a battery, a logic circuit, and at least one LED.

11. The toy assembly according to claim 10, wherein each of said internal illumination units contains a motion activator that activates said at least one LED when said internal illumination units experience motion.

12. The toy assembly according to claim 10, wherein said logic circuit causes said at least one LED to remain active for a predetermined period of time after said motion.

13. The toy assembly according to claim 7, wherein both said first translucent ball and said second translucent ball have elastomeric shells.

* * * * *